US005620335A

United States Patent [19]

Siemon

[11] Patent Number: 5,620,335

[45] Date of Patent: Apr. 15, 1997

[54] BOOT WITH ICON HOLDER

[75] Inventor: John A. Siemon, Woodbury, Conn.

[73] Assignee: The Siemon Company, Watertown, Conn.

[21] Appl. No.: 406,033

[22] Filed: Mar. 17, 1995

[51] Int. Cl.[6] ..... H01R 3/00

[52] U.S. Cl. ..... 439/491; 439/447

[58] Field of Search ..... 439/445, 447, 439/488, 491

[56] References Cited

U.S. PATENT DOCUMENTS

| | | | |
|---|---|---|---|
| 5,114,363 | 5/1992 | Mitra | 439/491 |
| 5,217,190 | 6/1993 | Reed et al. | 248/27.3 |
| 5,228,869 | 7/1993 | Below | 439/536 |
| 5,295,869 | 3/1994 | Siemon et al. | 439/620 |
| 5,334,044 | 8/1994 | Falossi et al. | 439/491 |

OTHER PUBLICATIONS

R.J. Enterprises, "Plug Protector".
Rainford, "RJ45 Retro–Fit Boot".
Ortronics Inc., Instructions.
Ortronics, Inc., "Color Coded Identifiers".

*Primary Examiner*—Neil Abrams
*Assistant Examiner*—Barry Matthew L. Standig
*Attorney, Agent, or Firm*—Fishman, Dionne & Cantor

[57] ABSTRACT

A strain relief boot is presented that has provisions to accept and retain a novel marking insert or icon that snap lockedly engages a recess in the well of the boot for ready identification of the device that the strain relief boot is protecting.

16 Claims, 4 Drawing Sheets

BOOT WITH ICON HOLDER

BACKGROUND OF THE INVENTION

This invention relates to a strain relief device for connectors used with telecommunication devices. More particularly, this invention relates to snap locking icons or inserts that fit strain relief boots for easy identification of the telecommunication plug or receptacle being used.

Strain relief boots are well known in the telecommunications art. FIG. 1 shows a prior art boot that is made of a suitable material such as rubber or plastic and is designed to provide strain relief to respond to and protect against movement, vibrations or a disconnect motion. Although suitable for the purpose intended, this prior art boot has the major drawback that it does not carry identification on the outside surface of the boot. Because of the often congested nature found at telecommunication device terminals, it is difficult to know precisely what signals are being sent from the other end of the cable. Sometimes the jack will carry identification, but again, because of the multiplicity of cables usually associated with telecommunication devices or consoles, it is difficult to know whether it is a computer, telephone or other type of line that is being connected. Telecommunication devices are generally very sensitive and should the wrong telecommunication plug be inserted into the incorrect jack, damage could occur to this sensitive equipment.

The FIG. 2 prior art is another type of strain relief boot in the market which does have a sliding element which can be used to identify the type of telecommunications plug that the strain relief boot is mounted to or designates. This second prior art strain relief boot has the advantage of plug identification relative to the first embodiment. However, because the identification window is held in place on only two sides, this window (usually of plastic material) can be easily removed and/or may fall out due to motion or vibration and is therefore easily mislaid or lost. This has proven to be a problem in the field and is a particularly severe problem when used with frequently handled patch cords and the like.

SUMMARY OF THE INVENTION

The above discussed and other problems and deficiencies of the prior art are overcome or alleviated by the boot with icon holder of the present invention. In accordance with the present invention, a strain relief boot is provided that has provisions to accept and retain a marking insert or icon by providing a recessed area IN a wall of the boot. Preferably, the wall contains one or more apertures at the bottom of the recess to retain the marking insert or icon. Preferably, the insert or icon has two or more protrusions that engage snap lockedly into the apertures. An extension slot is also provided to allow the insertion of a removal tool to force the insert out for replacement or substitution.

The strain relief boot used in the present invention may have any suitable configuration and may be a one-piece boot or be comprised of two or more members which interengage to form the boot.

Similarly, the insert or icon can be of any desired shape such as rectangular, oval or circular. Such icons can include any desired indicia thereon such as a symbol (e.g., telephone, computer) or wording. The icon can also be used for color coding. The above-discussed and other features and advantages of the present invention will be appreciated and understood by those skilled in the art from the following detailed description and drawing.

BRIEF DESCRIPTION OF THE DRAWINGS

Referring now to the drawings wherein like elements are numbered alike in the several FIGURES.

DETAILED DESCRIPTION OF THE INVENTION

Figure 1:
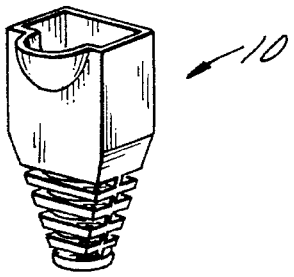
FIG. 1 (PRIOR ART)
FIG. 1 is a perspective view of a strain relief boot of the prior art which has no provisions for easy identification.

Referring first to FIG. 1, a strain relief boot known to the art and manufactured in a known manner is made of either rubber or plastic material to provide strain relief when installed over a connector in the telecommunications field and is generally shown at 10. Strain relief boot 10 is generally suitable for its intended purpose. However, the majority of materials used to make device 10 are generally opaque. Thus, when the boot is installed in place, it is generally hard or impossible to see the identification that may or may not be installed on the receptacle end and mixups can very easily occur.

Figure 2:
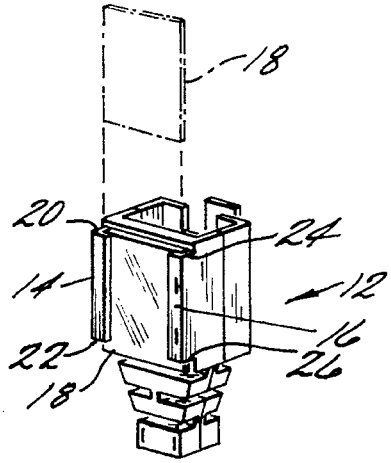
FIG. 2 (PRIOR ART)
FIG. 2 is a perspective view of a strain relief boot of the prior art which has easily displaced or poor identification provisions.

The prior art of FIG. 2 attempts to resolve the above problem. The prior art strain relief boot of FIG. 2 is generally shown at 12. Boot 12 comprises two lips 14 and 16 into which is received a plastic (or other material) window 18 on which identification of the connector may be marked. Because lips 14, 16 are open on each end 22, 22, 24 and 26, window 18 may slip out of either end due to vibration, disconnect motion or other forces to which the connector is subjected upon which boot 12 is mounted. A further problem may occur should window 18 edges be damaged, precluding ready reinsertion into lips 14, 16.

Figure 3:
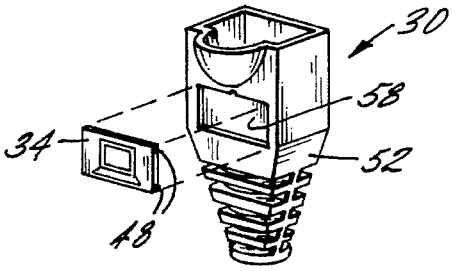
FIG. 3 is a first preferred perspective view of a strain relief boot with identification provisions in accordance with the present invention.
Figure 5A:
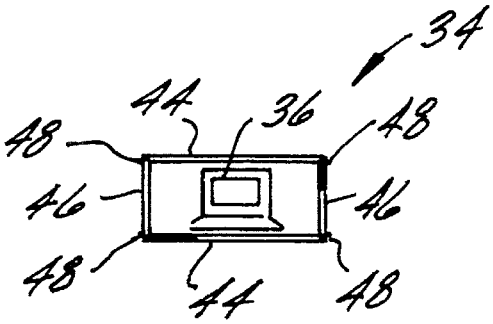
FIG. 5A is a front elevation view of an insert or icon for use with the strain relief boot of either FIG. 3 or FIG. 4 depicting a telecommunications device such as a computer terminal.
Figure 5B:
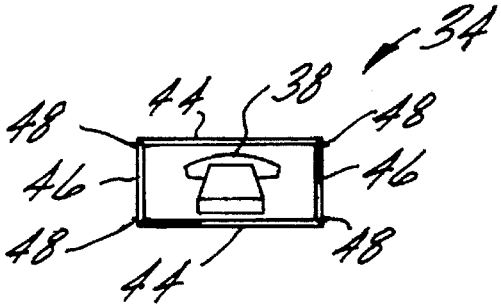
FIG. 5B is a front elevation view of an insert or icon for use with the strain relief boot of either FIG. 3 or FIG. 4 depicting a telecommunications device such as a telephone.
Figure 5C:
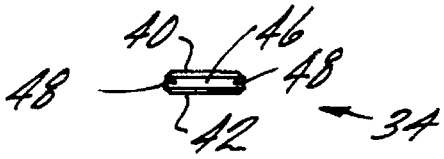
FIG. 5C is a left or right end view of the insert or icon of FIG. 5A or 5B.
Figure 5D:
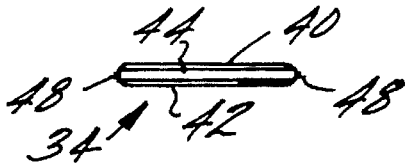
FIG. 5D is a top or bottom view of the insert or icon of FIG. 5A or 5B.
Figure 7:
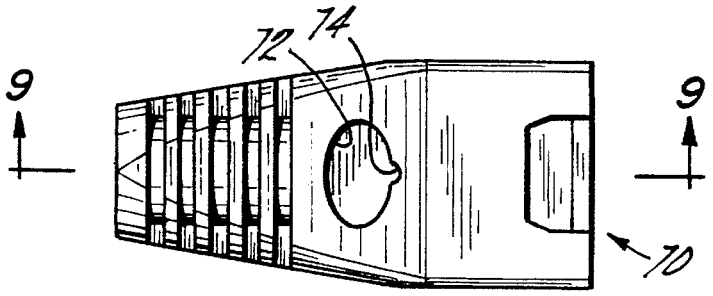
FIG. 7 is a front elevation view of a strain relief boot in accordance with an alternative embodiment of the present invention.
Figure 8:
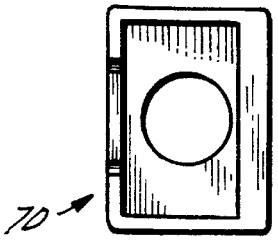
FIG. 8 is a right end view of the boot of FIG. 7.
Figure 9:
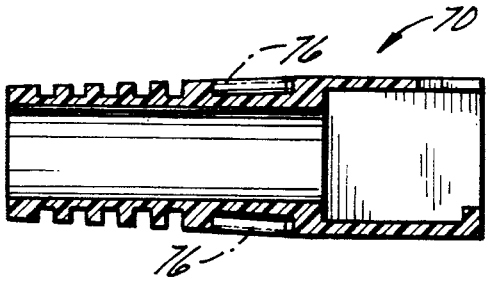
FIG. 9 is a cross-sectional elevation view of the boot of FIG. 7.
Figure 12A:
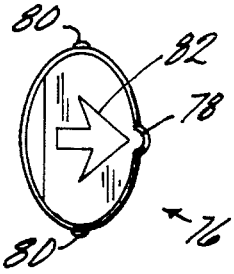
FIGS. 12A–D are respective front, right side, rear and end views of an oval icon used in the boot of FIG. 7.
Figure 12B:
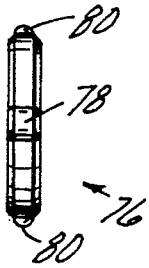
Figure 12C:
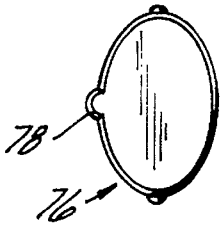
Figure 12D:
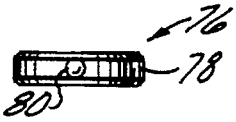

Referring now to FIG. 3, a strain relief boot in accordance with a first embodiment of this present invention is generally shown at 30. Strain relief boot 30 is quite similar to the prior art strain relief boot of FIG. 1 except for the provision of recess 32 capable of snap lockedly receiving insert 34. Referring now to FIGS. 5A–5D, insert 34 is shown in a front elevation view in both FIGS. 5A and 5B. In FIG. 5A, the icon 36 shown is that of a computer terminal whereas in FIG. 5B the icon 38 is a telephonic symbol. Of course any other appropriate symbol or icon or other suitable indicia such as wording can be accommodated on the insert. The insert may also be color coded and simply consist of a particular color for identification purposes. It should further be noted that although insert 34 in FIGS. 5A and 5B are shown in rectangular shape, any other appropriate shape such as a square, circle or oval or other shape can be used with equal success (see FIGS. 7–12).

Insert 34 comprises a pair of opposing surfaces 40, 42 and first and second edges 44 and 46 which are chamfered. A pair of protruding elements 48 extend from each surface 46. Insert 34 is snap lockedly inserted into recess 32. Recess 32 (see FIG. 3) is sized to accept insert 34 snap lockedly so that after assembly, insert 34 is flush with surface 50 of strain relief boot 30. An aperture 52 is located at each of the four corners of recess 32 to receive the four protruding elements 48 snap lockedly into the four apertures 52 as shown in FIG. 3. An extension slot 54 is provided to allow insertion of a tool (not shown) to remove insert 34 so that another insert 34 might be installed to replace the original insert 34 should the terminal be changed for any reason. This also allows the boot 30 to be reused for a different application. The four dashed lines 56 in FIG. 3 show the paths of the elements 48 during installation. As previously stated above, the extension slot 54 allows removal of insert 34 by inserting a rigid member (not shown) between insert 34 and the bottom face 58 of recess 32. The rigid member is urged outwardly until protruding elements 48 are released from apertures 52. Insert 34 is then easily removed from strain relief boot 30.

Figure 4:
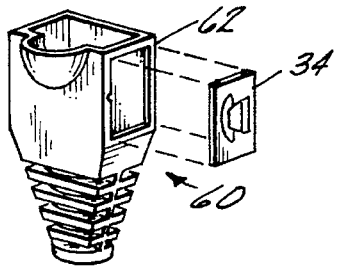
FIG. 4 is a second preferred perspective view of a strain relief boot with identification provisions in accordance with the present invention.
Figure 6:
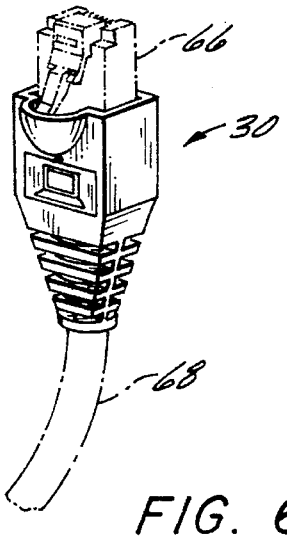
FIG. 6 is a perspective of the strain relief boot of FIG. 3 shown in the installed condition on a typical telecommunications plug.

Referring now to FIG. 4, a second preferred embodiment in accordance with the present invention is generally shown at 60. Strain relief boot 60 is identical to strain relief boot 30 except that the recess 32 and its elements are rotated 90° to one of the two side faces of boot 60 so that the insert 34 fits into the narrower side 62 of the boot 60. In all other ways, this second preferred embodiment of boot 60 is identical to the same elements of boot 30. FIG. 6 shows a perspective view of the boot of FIG. 3 designated 30 installed on a known telecommunications plug 66. Plug 66 and cable 68 are shown in phantom lines.

Referring now to FIGS. 7–12, a third alternative embodiment of the present invention will now be described. In this third embodiment, a boot is shown generally at 70 and is similar to the boot 30 shown in FIG. 3. An important distinction between boot 70 and boot 30 is the presence in boot 70 of an oval recess 72 having a centrally disposed semi-circular protrusion 74 which points in the direction of the widest opening of boot 70. Recess 72 is shaped to receive an oval insert 76 which is shown in FIGS. 12A–D and is also shown disposed in recess 72 in FIG. 9. Oval insert 76 also includes a centrally disposed semi circular protrusion 78 having a size commensurate with the protrusion 74 in recess 72. Either end of oval insert 76 includes small protrusions 80 which are sized to be retained by the recessed area at the bottom edge of recess 72. Preferably, boot 70 is made of a resilient rubbery or elastomeric material which allows extensions 80 to be snap lockedly received in the walls of recess 72. As with insert 34, insert 76 may include any suitable indicia thereon or may simply be color coded. In this example, insert 76 includes an arrow icon.

Figure 10:
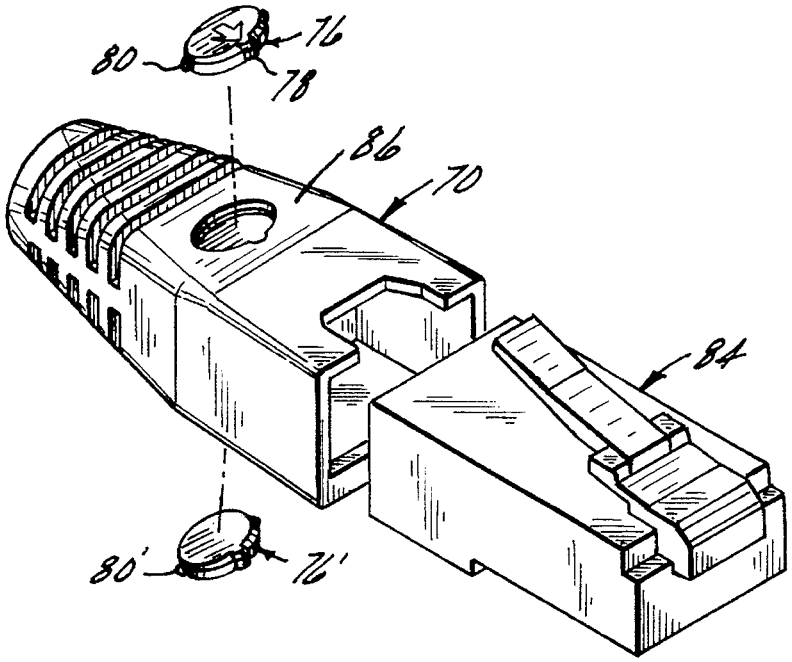
FIGS. 10 and 11 are respective front and rear perspective views of the boot of FIG. 7 being attached to a modular plug.
Figure 11:
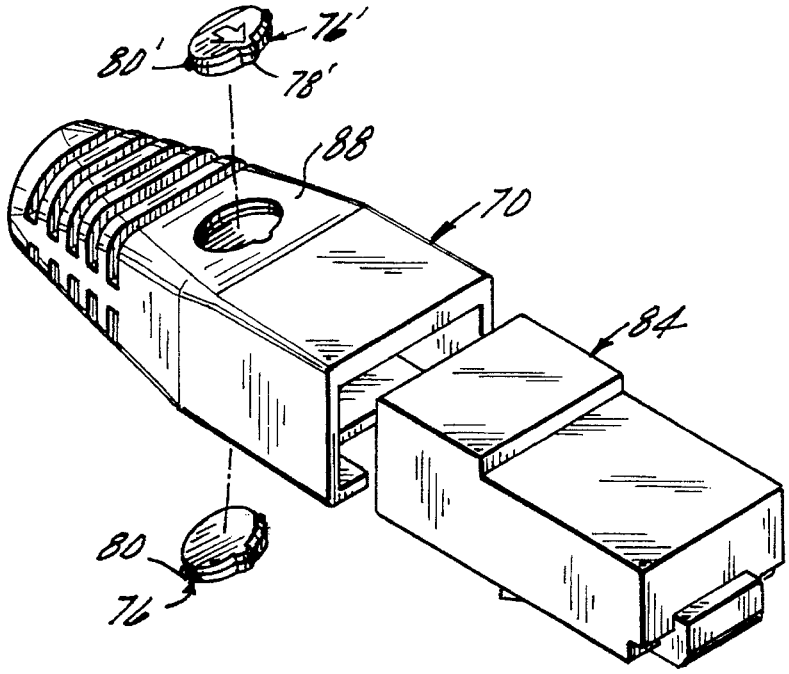

Referring to FIGS. 10 and 11, boot 70 is shown after being positioned onto a well known modular plug 84. Of course, insert 76 may be positioned upon any desired side of boot 70. In the examples shown in FIGS. 10 and 11, two inserts 76 and 76' are disclosed on opposed front and rear surfaces 86 and 88, respectively of boot 70.

While the present invention has been shown in conjunction with an integral one-piece boot 30 or 70, it will be appreciated that the present invention may also be utilized with any other boot configuration including the prior art boot configuration shown in FIG. 2 which consists of a pair of plastic housing which are snap locked together to form an integral housing shown in FIG. 2.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A strain relief boot comprising:

at least one flat recess capable of receiving and retaining an identification insert;

a flat identification insert disposed in said recess.

2. The boot of claim 1 wherein:

said insert is snap-locked into said recess.

3. The boot of claim 2 including:

at least one protruding element extending outwardly from opposing sides of said insert and at least one aperture formed in said recess, said protruding elements engaging said apertures.

4. The boot of claim 1 wherein said insert has first and second opposed edges that are chamfered.

5. The boot of claim 2 wherein at least one protruding element extends from each end of said insert.

6. The boot of claim 1 wherein said recess has a depth and wherein the depth of said recess allows for flush mounting of said insert.

7. The boot of claim 1 including protruding elements on said insert for snap lockedly engaging apertures at the bottom of said recess.

8. The boot of claim 1 including an extension slot on said recess for allowing insertion of a removal tool.

9. The boot of claim 1 wherein said insert is rectangular.

10. The boot of claim 1 wherein said insert is oval.

11. The boot of claim 1 including indicia on said insert.

12. The boot of claim 11 wherein said indicia comprises a symbol.

13. The boot of claim 11 wherein said indicia is color coded.

14. The boot of claim 1 including:

a plurality of recesses in said boot, each of said recesses receiving an identification insert.

15. The boot of claim 1 wherein said boot is one-piece.

16. The boot of claim 15 wherein said boot is comprised of an elastomeric material.

* * * * *

US005620335C1

(12) REEXAMINATION CERTIFICATE (4269th)

United States Patent

Siemon

(10) Number: US 5,620,335 C1

(45) Certificate Issued: Feb. 6, 2001

(54) BOOT WITH ICON HOLDER

(75) Inventor: John A. Siemon, Woodbury, CT (US)

(73) Assignee: The Siemon Company, Watertown, CT (US)

Reexamination Request:
No. 90/005,109, Sep. 17, 1998

Reexamination Certificate for:

| | |
|---|---|
| Patent No.: | **5,620,335** |
| Issued: | **Apr. 15, 1997** |
| Appl. No.: | **08/406,033** |
| Filed: | **Mar. 17, 1995** |

(51) Int. Cl.[7] ..... H01R 3/00

(52) U.S. Cl. ..... 439/491; 439/447

(58) Field of Search ..... 439/445, 447, 439/488, 491

(56) References Cited

U.S. PATENT DOCUMENTS 4,704,091 * 11/1987 Owens et al. ..... 439/281
4,784,614 * 11/1988 Sadigh-Behzadi ..... 439/488

OTHER PUBLICATIONS

Molex, FDDI Connector & Adapters, Termination Procedures, 1992 (sketch of boot insert).

* cited by examiner

*Primary Examiner*—Brian Sircus

(57) ABSTRACT

A strain relief boot is presented that has provisions to accept and retain a novel marking insert or icon that snap lockedly engages a recess in the well of the boot for ready identification of the device that the strain relief boot is protecting.

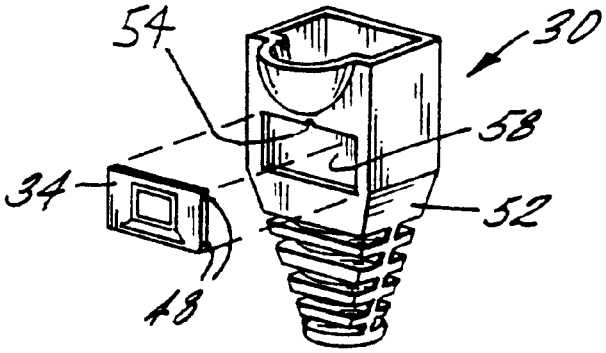

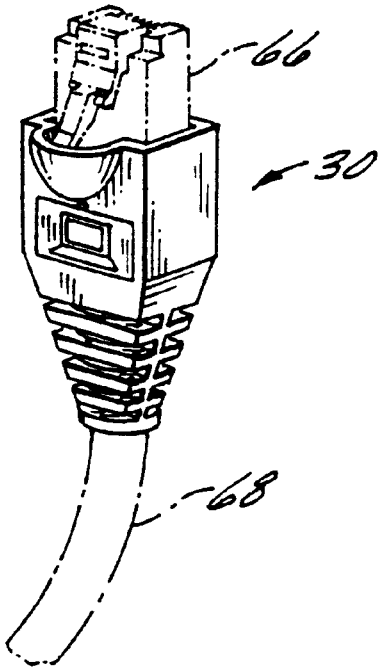

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–16 are cancelled.

New claims 17–28 are added and determined to be patentable.

*17. A strain relief boot comprising:*

*at least one flat recess capable of receiving and retaining an identification insert, said recess including an extension slot, said recess further including an aperture formed in said recess;*

*a flat identification insert disposed in said recess, said insert including at least one first protruding element extending outwardly from said insert, said first protruding element engaging said aperture;*

*said insert further including a second protrusion for engaging said extension slot.*

*18. The boot of claim 17 wherein:*

*said boot includes a first opening for receiving a cable and a second opening for receiving a plug;*

*said extention slot points towards said second opening.*

*19. The boot of claim 17 wherein said recess has a depth and wherein the depth of said recess allows for flush mounting of said insert.*

*20. The boot of claim 17 wherein said insert is snap-locked into said recess.*

*21. The boot of claim 17 wherein said insert has edges that are chamfered.*

*22. The boot of claim 17 wherein at least one first protruding element extends from each end of said insert.*

*23. The boot of claim 17 including indicia on said insert.*

*24. The boot of claim 23 wherein said indicia comprises a symbol.*

*25. The boot of claim 17 wherein said insert is color coded.*

*26. The boot of claim 17 including:*

*a plurality of recesses in said boot,*

*each of said recesses receiving an identification insert.*

*27. The boot of claim 17 wherein said boot is one piece.*

*28. The boot of claim 17 wherein said boot is comprised of an elastomeric material.*

* * * * *